US007653956B2

(12) United States Patent
Smith

(10) Patent No.: US 7,653,956 B2
(45) Date of Patent: Feb. 2, 2010

(54) METHOD OF MANUFACTURING FOOTWEAR OF DIFFERING WIDTHS

(75) Inventor: Steven F. Smith, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 622 days.

(21) Appl. No.: 11/558,482

(22) Filed: Nov. 10, 2006

(65) Prior Publication Data

US 2008/0109969 A1 May 15, 2008

(51) Int. Cl.
*A43D 25/00* (2006.01)

(52) U.S. Cl. ..... 12/142 T; 36/97

(58) Field of Classification Search ..... 12/142 RS, 12/142 T, 142 R; 36/97, 100, 101
See application file for complete search history.

(56) References Cited

U.S. PATENT DOCUMENTS 6,237,255 B1 * 5/2001 Renaudin et al. ..... 36/97
6,718,658 B2 * 4/2004 Karasawa ..... 36/97
7,318,260 B2 * 1/2008 Pearce ..... 12/142 T
2006/0130364 A1 * 6/2006 Greene et al. ..... 36/100
2007/0039208 A1 * 2/2007 Bove et al. ..... 36/97
2007/0039209 A1 * 2/2007 White et al. ..... 36/97

FOREIGN PATENT DOCUMENTS

JP 737521 8/1995

* cited by examiner

*Primary Examiner*—Ted Kavanaugh
(74) *Attorney, Agent, or Firm*—Banner & Witcoff, Ltd.

(57) ABSTRACT

A method of manufacturing footwear includes providing a first upper having a first size and positioning a first cushioning member, having a first recess of a first size, beneath the first upper. The first cushioning member is secured to the first upper and a first sole assembly to form a first article of footwear having a first size. A second cushioning member is positioned beneath a second upper having a second size different than the first upper's size. The second cushioning member has a second recess of a second size formed in an upper surface thereof, with the second size being different than the first size of the first recess. The second cushioning member is secured to the second upper and a second sole assembly to form a second article of footwear having a second size different than the first size of the first article of footwear.

27 Claims, 3 Drawing Sheets

METHOD OF MANUFACTURING FOOTWEAR OF DIFFERING WIDTHS

FIELD OF THE INVENTION

This invention relates generally to a method of manufacturing footwear, and, in particular, to a method of manufacturing footwear having different widths.

BACKGROUND OF THE INVENTION

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

Footwear is manufactured in multiple sizes and widths. Manufacturing footwear having different widths for each individual size typically requires an extensive amount of tooling and retooling to accommodate the different sized uppers and sole assemblies, thereby resulting in high manufacturing costs and assembly time.

It would be desirable to provide a method of manufacturing footwear having different widths that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide a method of manufacturing footwear having different widths. In accordance with a first aspect, a method of manufacturing footwear of different sizes includes steps of providing a first upper having a first size; positioning a first cushioning member beneath the first upper, with the first cushioning member having a first recess of a first size formed in an upper surface thereof; positioning a first sole assembly having a first size beneath the first cushioning member; securing the first cushioning member to the first upper and to the first sole assembly to form a first article of footwear having a first size; providing a second upper having a second size that is different from the first size of the first upper; positioning a second cushioning member beneath the second upper, with the second cushioning member having a second recess of a second size formed in an upper surface thereof, the second size being different than the first size of the first recess; positioning a second sole assembly having a second size beneath the second cushioning member, with the second size being the same as the first size of the first cushioning member; and securing the second cushioning member to the second upper and to the second sole assembly to form a second article of footwear having a second size that is different than the first size of the first article of footwear.

In accordance with another aspect, a method of manufacturing footwear of different sizes includes the steps of providing a first upper having a first size; securing a first cushioning member to a bottom surface of the first upper, with the first cushioning member having a first recess of a first size formed in an upper surface thereof, securing a first sole assembly having a first size to a bottom surface of the first cushioning member to form a first article of footwear having a first size; providing a second upper having a second size that is different from the first size of the first upper; securing a second cushioning member to a bottom surface of the second upper, with the second cushioning member having a second recess of a second size formed in an upper surface thereof, the second size being different than the first size of the first recess; and securing a second sole assembly having a second size to a bottom surface of the second cushioning member, with the second size being the same as the first size of the first cushioning member to form a second article of footwear having a second size that is different than the first size of the first article of footwear.

In accordance with a further aspect, a method of manufacturing footwear of different sizes includes the steps of providing a first upper having a first width; securing a first cushioning member to a bottom surface of the first upper, with the first cushioning member having a first recess of a first size formed in an upper surface thereof, securing a first sole assembly having a first size to a bottom surface of the first cushioning member to form a first article of footwear having a first width; providing a second upper having a second width that is different from the first width of the first upper; securing a second cushioning member to a bottom surface of the second upper, with the second cushioning member having a second recess of a second size formed in an upper surface thereof, with the second size being different than the first size of the first recess, and with the second cushioning member having a width the same as a width of the first cushioning member; and securing a second sole assembly having a second size to a bottom surface of the second cushioning member, with the second size being the same as the first size of the first cushioning member, to form a second article of footwear having a second width that is different than the first width of the first article of footwear.

Substantial advantage is achieved by providing a method of manufacturing footwear having different widths. In particular, certain embodiments reduce the tooling and material needed to make articles of footwear of different widths, thus reducing manufacturing costs.

These and additional features and advantages disclosed here will be further understood from the following detailed disclosure of certain embodiments.

Figure 1:
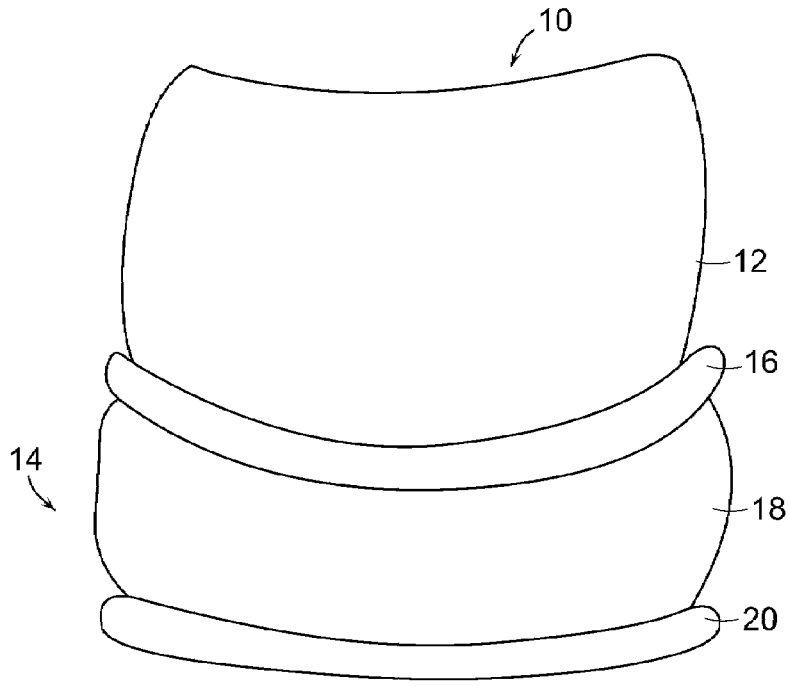
FIG. 1 is a rear elevation view of an article of footwear having a sole assembly and an upper.

The figures referred to above are not drawn necessarily to scale and should be understood to provide a representation of the invention, illustrative of the principles involved. Some features of the footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

The following discussion and accompanying figures disclose various embodiments of a sole structure for an article of footwear. Concepts related to the sole structure are disclosed with reference to footwear having a configuration that is suitable for athletic activities, e.g., the sport of basketball. However, the sole structure may be applied to a wide range of athletic footwear styles, including tennis shoes, football shoes, cross-training shoes, walking shoes, soccer shoes, and hiking boots, for example. The sole structure may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

Figure 2:
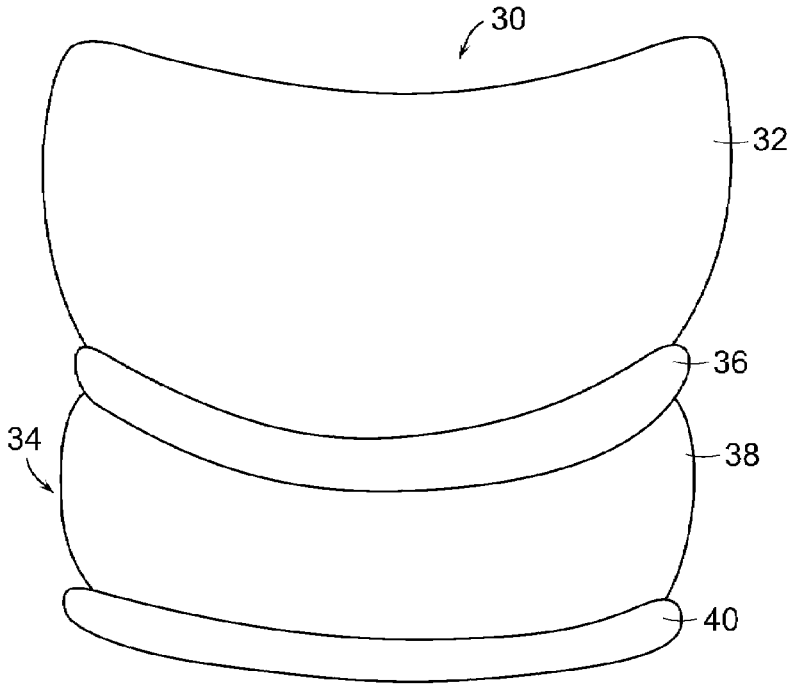
FIG. 2 is a rear elevation of an article of footwear having a sole assembly of the same size as the article of footwear of FIG. 1, and an upper having a width greater than that of the upper of the article of footwear of FIG. 1.
Figure 3:
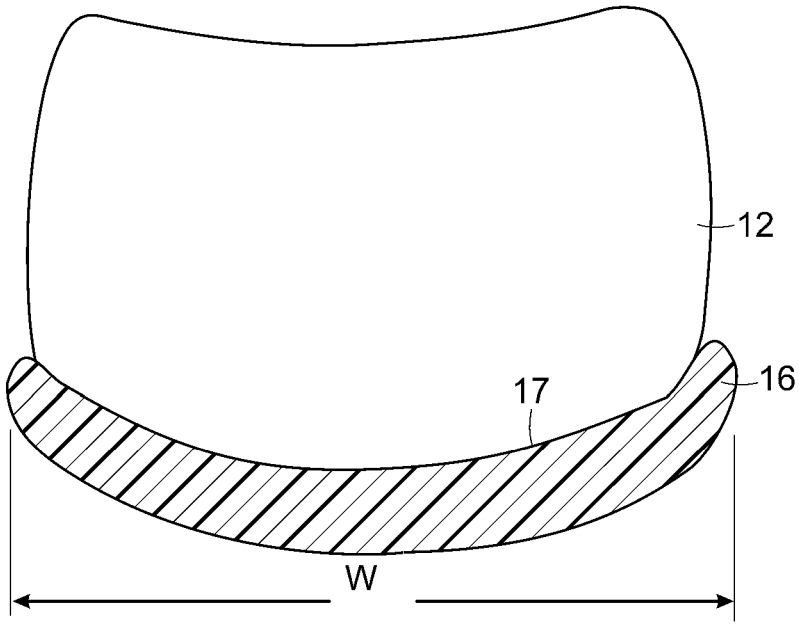
FIG. 3 is a partial rear section view of the article of footwear of FIG. 1.
Figure 4:
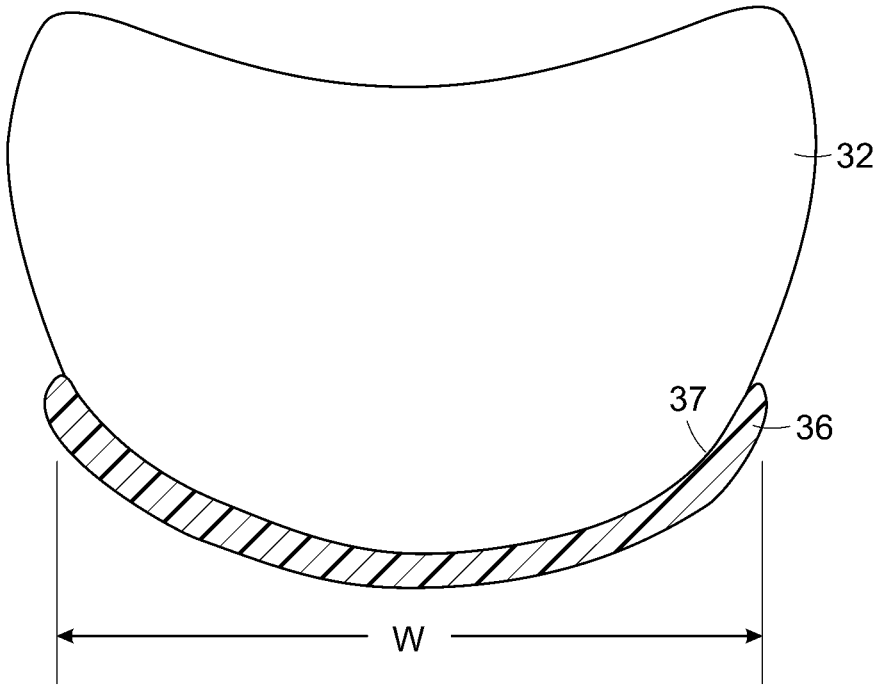
FIG. 4 is a partial rear section view of the article of footwear of FIG. 2.

An article of footwear 10 is depicted in FIGS. 1 and 2 as including an upper 12, a sole assembly 14 positioned beneath upper 12, and a cushioning element 16 positioned between upper 12 and sole assembly 14. Upper 12 forms an interior void that comfortably receives a foot and secures the position of the foot relative to sole assembly 14. The configuration of upper 12, as depicted, is suitable for use during athletic activities that primarily involve running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole assembly 14 may be secured to upper 12 by an adhesive, or any other suitable fastening means. Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, a midsole 18, and an outsole 20. Midsole 18 functions as the primary shock-attenuating and energy-absorbing component of footwear 10. Outsole 20 is attached to the lower surface of midsole 18 and is preferably formed of a stiff material, providing support for the runner's foot in the sprinting position. Suitable materials for outsole 20 include traditional rubber materials. Other suitable materials for outsole 20 will become readily apparent to those skilled in the art, given the benefit of this disclosure. In certain embodiments, sole assembly 14 may not include an outsole layer separate from midsole 18 but, rather, the outsole may comprise a bottom surface of midsole 18 that provides the external traction surface of sole assembly 14.

As noted above, a cushioning element 16 is provided between upper 12 and midsole 18 of sole assembly 14. Cushioning element 16 may be formed of a foam polymer, such as polyurethane (PU) or ethyl vinyl acetate (EVA), for example. Other suitable materials for cushioning element 16 will become readily apparent to those skilled in the art, given the benefit of this disclosure.

An illustration of manufacturing articles of footwear having different widths is illustrated in FIGS. 1-4. In assembling the first article of footwear 10 of FIG. 1, a first upper 12, which has a first size, is adhesively secured to a first cushioning element 16, which has a first recess 17 having a first size formed in its upper surface. First cushioning element 16 has a width W. First cushioning element 16 is in turn adhesively secured to a first sole assembly 14 having a first size. In the illustrated embodiment, first cushioning element 16 is adhesively secured to midsole 18, with outsole 20 being adhesively secured to midsole 18.

A second article of footwear 30 having a different width than that of first article of footwear 10 is seen in FIG. 2. Second article of footwear 30 can advantageously be formed using a sole assembly 34 having the same size as sole assembly 14 of first article of footwear 10 of FIG. 1.

As illustrated in FIG. 2, a second upper 32 having a second size is secured to a second sole assembly 34, which has the same size as that of first sole assembly 14 seen in FIG. 1. In this embodiment, the size of second upper 32 is larger, more specifically, wider, than the first size of first upper 12 of FIG. 1.

In order to accommodate the wider second upper 32, a second cushioning element 36 is used, which has a second recess 37 formed in its upper surface. Second cushioning element 36 has the same width W as first cushioning element 16. However, second recess 37 has a second size that is larger than the first size of first recess 17, as can be seen most clearly in FIGS. 3-4. Thus, the larger-sized second recess 37 helps to accommodate the larger sized second upper 32 with a second cushioning element 36 having the same width as first cushioning element 16.

Conversely, it is to be understood an article of footwear with a narrower width can also be formed using the same sized sole assembly. It can be seen that to go from the second upper 32 of the second article of footwear 30 of FIG. 2 to the narrower first upper 12 of first article of footwear 10 of FIG. 1, a first cushioning element 16 with a first recess 17 that is smaller than the second recess 37 of the second cushioning element 36 helps to accommodate the smaller sized upper.

Figure 5:
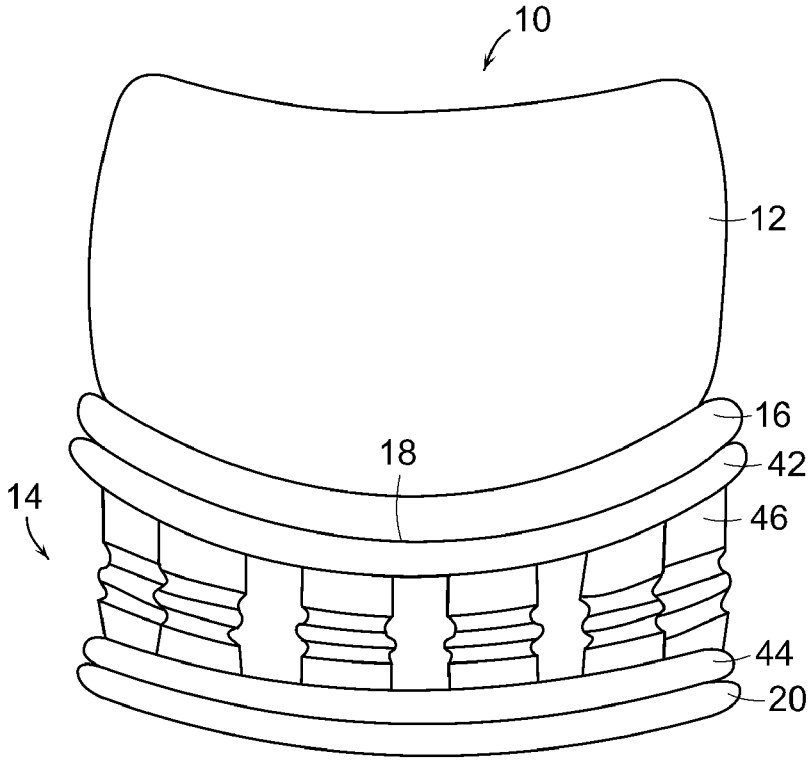
FIG. 5 is a rear elevation view of an article of footwear having a sole assembly incorporating a plurality of elastomeric support columns, and an upper.

Another embodiment of first article of footwear 10 is shown in FIG. 5, where at least a portion of midsole 18 includes a top plate 42, a bottom plate 44, and a plurality of elastomeric support columns 46 extending between top plate 42 and bottom plate 44. As depicted here, support columns 46 have a generally cylindrical configuration. It is to be appreciated that support columns 46 may have a variety of other columnar configurations including oval, pyramidal, cubic, conic, or any other regular geometric shape. In addition to regular shapes, support columns 46 may have an irregular geometric shape. Suitable materials for support columns 46 include rubber, polyurethane foam, microcellular elastomeric foams, or phylon (EVA foam). Other suitable materials for support columns 46 will become readily apparent to those skilled in the art, given the benefit of this disclosure. It is to be appreciated that the top plate 42, bottom plate 44 and support columns 46 may be positioned in only a portion of sole assembly 14, extend along its entire length, or be positioned in more than one portion of sole assembly 14. Thus, for example, top plate 42, bottom plate 44 and support columns 46 may be found only in the heel portion of sole assembly 14 while the remainder of sole assembly 14 has conventional midsole 18.

Figure 6:
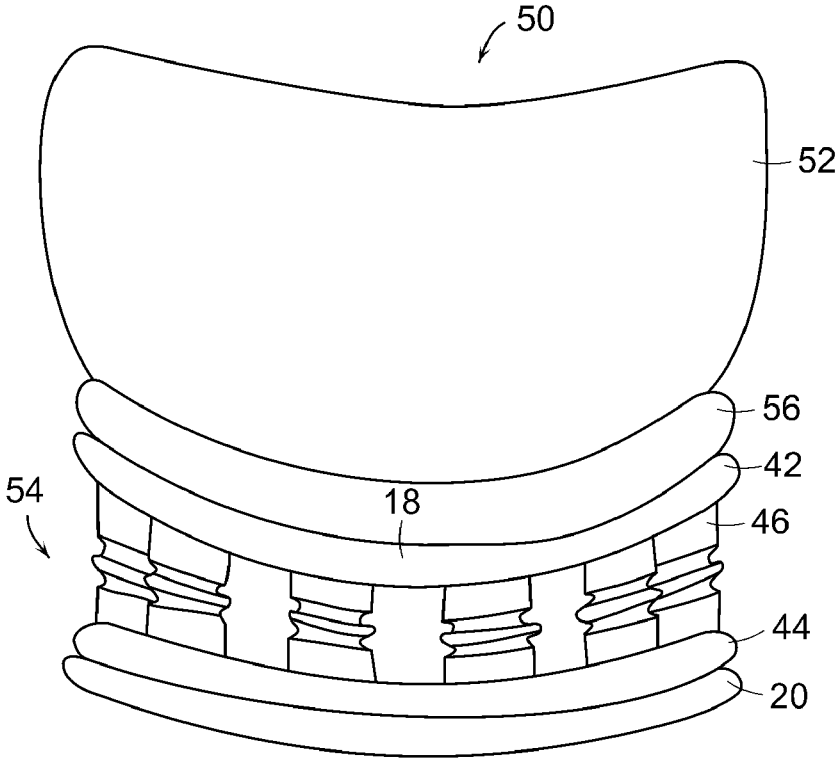
FIG. 6 is a rear elevation of an article of footwear having a sole assembly of the same size as the article of footwear of FIG. 5, and an upper having a width greater than that of the upper of the article of footwear of FIG. 5.

A second article of footwear 50 having a different width than that of first article of footwear 10 of FIG. 5 can advantageously be formed using the same sole assembly 14. As illustrated in FIG. 6, second article of footwear 50 has a second upper 52 having a second size that is larger than the first size of first upper 12 of FIG. 5. Second upper 52 is secured to a second sole assembly 54 that has the same size as first sole assembly 14 of FIG. 5. A second cushioning element 56 has a second recess (not shown) that is larger than the size of a first recess (not shown) formed in the upper surface of first cushioning element 16 used in first article of footwear 10 of FIG. 5, in a manner similar to that described above with respect to FIGS. 1-4. This larger-sized second recess allows second cushioning element 56 to accommodate the wider second upper 52 found in second article of footwear 50 of FIG. 6, while the width of second cushioning element 56 is the same of that of first cushioning element 16.

Conversely, it is to be understood an article of footwear with a narrower width can also be formed using the same sized sole assembly. It can be seen that to go from second upper 52 of second article of footwear 50 of FIG. 6 to the narrower first upper 12 of first article of footwear 10 of FIG. 5, the first recess in first cushioning element 16 is smaller than the second recess in second cushioning element 56, which helps to accommodate the smaller sized first upper 12.

Accommodating uppers of different widths on the same sole assemblies advantageously allows a significant reduction in the tooling required to manufacture footwear of different widths, thereby reducing manufacturing costs and assembly times.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. A method of manufacturing footwear of different sizes comprising the following steps:

providing a first upper having a first size;

positioning a first cushioning member beneath the first upper, the first cushioning member having a first recess of a first size formed in an upper surface thereof;

positioning a first sole assembly having a first size beneath the first cushioning member;

securing the first cushioning member to the first upper and to the first sole assembly to form a first article of footwear having a first size;

providing a second upper having a second size that is different from the first size of the first upper;

positioning a second cushioning member beneath the second upper, the second cushioning member having a second recess of a second size formed in an upper surface thereof, the second size being different than the first size of the first recess;

positioning a second sole assembly having a second size beneath the second cushioning member, the second size being the same as the first size of the first cushioning member; and securing the second cushioning member to the second upper and to the second sole assembly to form a second article of footwear having a second size that is different than the first size of the first article of footwear.

2. The method of claim 1, wherein the first size of the first upper is larger than the second size of the second upper.

3. The method of claim 1, wherein the first size of the first upper is smaller than the second size of the second upper.

4. The method of claim 1, wherein first upper is wider than the second upper.

5. The method of claim 1, wherein the first upper is narrower than the second upper.

6. The method of claim 1, wherein the first size of the first recess is smaller than the second size of the second recess.

7. The method of claim 1, wherein the first size of the first recess is larger than the second size of the second recess.

8. The method of claim 1, wherein each of the first sole assembly and the second sole assembly comprises a midsole and an outsole secured to the midsole.

9. The method of claim 8, wherein at least a portion of the midsole of each of the first sole assembly and the second sole assembly comprises:

a top plate;

a bottom plate, and a plurality of elastomeric support columns extending between the top plate and the bottom plate.

10. The method of claim 1, wherein a width of the first cushioning member is the same as a width of the second cushioning member.

11. A method of manufacturing footwear of different sizes comprising the following steps:

providing a first upper having a first size;

securing a first cushioning member to a bottom surface of the first upper, the first cushioning member having a first recess of a first size formed in an upper surface thereof;

securing a first sole assembly having a first size to a bottom surface of the first cushioning member to form a first article of footwear having a first size;

providing a second upper having a second size that is different from the first size of the first upper;

securing a second cushioning member to a bottom surface of the second upper, the second cushioning member having a second recess of a second size formed in an upper surface thereof, the second size being different than the first size of the first recess; and securing a second sole assembly having a second size to a bottom surface of the second cushioning member, the second size being the same as the first size of the first cushioning member to form a second article of footwear having a second size that is different than the first size of the first article of footwear.

12. The method of claim 11, wherein the first size of the first recess is smaller than the second size of the second recess.

13. The method of claim 11, wherein the first size of the first recess is larger than the second size of the second recess.

14. The method of claim 11, wherein a width of the first cushioning member is the same as a width of the second cushioning member.

15. The method of claim 11, wherein the first size of the first upper is larger than the second size of the second upper.

16. The method of claim 11, wherein the first size of the first upper is smaller than the second size of the second upper.

17. The method of claim 11, wherein the first upper is wider than the second upper.

18. The method of claim 11, wherein the first upper is narrower than the second upper.

19. The method of claim 11, wherein each of the first sole assembly and the second sole assembly comprises a midsole and an outsole secured to the midsole.

20. The method of claim 19, wherein at least a portion of the midsole of each of the first sole assembly and the second sole assembly comprises:

a top plate;

a bottom plate, and a plurality of elastomeric support columns extending between the top plate and the bottom plate.

21. A method of manufacturing footwear of different sizes comprising the following steps:

providing a first upper having a first width;

securing a first cushioning member to a bottom surface of the first upper, the first cushioning member having a first recess of a first size formed in an upper surface thereof;

securing a first sole assembly having a first size to a bottom surface of the first cushioning member to form a first article of footwear having a first width;

providing a second upper having a second width that is different from the first width of the first upper;

securing a second cushioning member to a bottom surface of the second upper, the second cushioning member having a second recess of a second size formed in an upper surface thereof, the second size being different than the first size of the first recess, the second cushioning member having a width the same as a width of the first cushioning member; and securing a second sole assembly having a second size to a bottom surface of the second cushioning member, the second size being the same as the first size of the first cushioning member, to form a second article of footwear having a second width that is different than the first width of the first article of footwear.

22. The method of claim 21, wherein the first size of the first recess is smaller than the second size of the second recess.

23. The method of claim 21, wherein the first size of the first recess is larger than the second size of the second recess.

24. The method of claim 21, wherein first upper is wider than the second upper.

25. The method of claim 21, wherein the first upper is narrower than the second upper.

26. The method of claim 21, wherein each of the first sole assembly and the second sole assembly comprises a midsole and an outsole secured to the midsole.

27. The method of claim 21, wherein at least a portion of the midsole of each of the first sole assembly and the second sole assembly comprises:

a top plate;

a bottom plate, and a plurality of elastomeric support columns extending between the top plate and the bottom plate.

* * * * *